US007556502B2

(12) United States Patent
Nakata et al.

(10) Patent No.: US 7,556,502 B2
(45) Date of Patent: Jul. 7, 2009

(54) CONNECTOR AND CONTACTS FOR USE IN THE CONNECTOR

(75) Inventors: Eiichi Nakata, Machida (JP); Takashi Kobayashi, Atsugi (JP); Ryo Kameoka, Yamato (JP); Hiroki Hihara, Kawasaki (JP)

(73) Assignees: ITT Manufacturing Enterprises, Inc., Wilmington, DE (US); NEC TOSHIBA Space System, LTD., Tokyo (JP)

( * ) Notice: Subject to any disclaimer, the term of this patent is extended or adjusted under 35 U.S.C. 154(b) by 0 days.

(21) Appl. No.: 11/896,673

(22) Filed: Sep. 5, 2007

(65) Prior Publication Data

US 2008/0057748 A1 Mar. 6, 2008

(30) Foreign Application Priority Data

Sep. 5, 2006 (JP) ..... 2006-240277

(51) Int. Cl.
*H01R 12/00* (2006.01)

(52) U.S. Cl. ..... 439/66

(58) Field of Classification Search ..... 439/66, 439/71, 74, 515

See application file for complete search history.

(56) References Cited

U.S. PATENT DOCUMENTS

| | | | | |
|---|---|---|---|---|
| 5,004,426 | A * | 4/1991 | Barnett | 439/82 |
| 5,037,311 | A * | 8/1991 | Frankeny et al. | 439/66 |
| 5,308,252 | A * | 5/1994 | Mroczkowski et al. | 439/66 |
| 6,877,992 | B2 * | 4/2005 | Grant et al. | 439/66 |
| 7,021,942 | B2 * | 4/2006 | Grant et al. | 439/66 |
| 7,255,573 | B2 * | 8/2007 | He et al. | 439/66 |

FOREIGN PATENT DOCUMENTS

| | | |
|---|---|---|
| JP | 2002-190335 | 7/2002 |

* cited by examiner

*Primary Examiner*—Phuong K Dinh
(74) *Attorney, Agent, or Firm*—Baker & Hostetler LLP

(57) ABSTRACT

A connector includes a plurality of contacts. The connector includes an insulator having a plurality of through-holes for receiving the contacts. A pair of contacts are disposed in each of the through-holes. Since two contacts are disposed in the through-hole in the insulator, even if a fault occurs in one of the contacts, signal transmission in the same line can continuously be used. Moreover, since large areas of contact portions of the contacts are secured even in normal use, the capacity of electric current is increased.

10 Claims, 7 Drawing Sheets

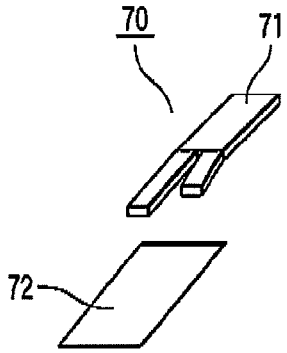
FIG. 7A
PRIOR ART
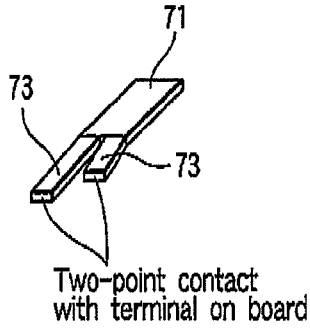
FIG. 7B
PRIOR ART
FIG. 8A
PRIOR ART
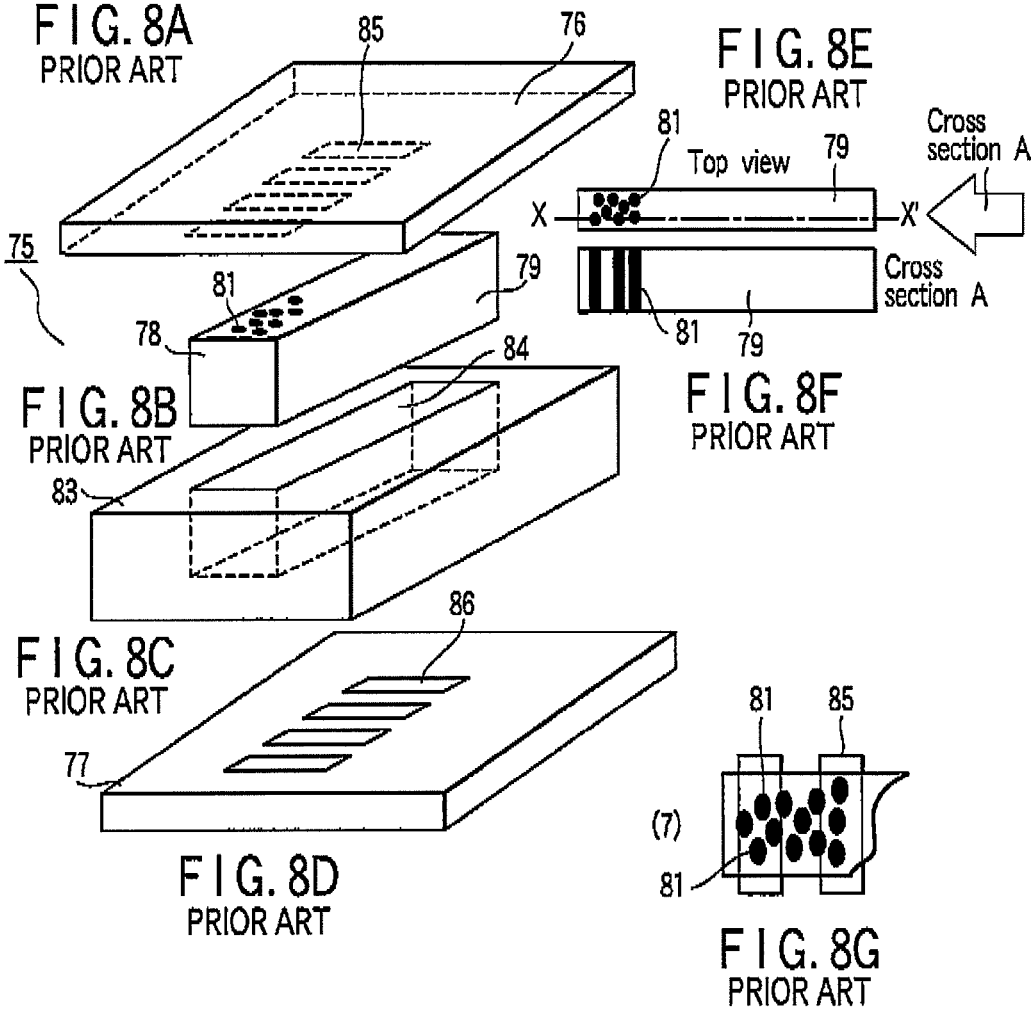
FIG. 8B
PRIOR ART
FIG. 8C
PRIOR ART
FIG. 8D
PRIOR ART
FIG. 8E
PRIOR ART
FIG. 8F
PRIOR ART
FIG. 8G
PRIOR ART

CONNECTOR AND CONTACTS FOR USE IN THE CONNECTOR

CROSS-REFERENCE TO RELATED APPLICATIONS

This application is based upon and claims the benefit of priority from prior Japanese Patent Application No. 2006-240277, filed Sep. 5, 2006, the entire contents of which are incorporated herein by reference.

BACKGROUND OF THE INVENTION

1. Field of the Invention

The present invention relates to a connector which is used in an electronic device having a plurality of circuit boards, and which electrically connects one of the circuit boards to another. In particular, the invention relates to an arrangement of contacts for use in the connector, and a structure of each contact.

2. Description of the Related Art

With developments in functions of electronic devices and with higher complexity of electronic devices, connectors each having many contact portions have been developed in order to interconnect many electrical wiring lines. In the case of the connector for use in, e.g. an artificial satellite, it is very difficult to repair or replace the connector after the artificial satellite is launched. Thus, high reliability is required in the connector as well as in the electronic devices which are mounted.

The electric connector that is used in the electronic device requiring high reliability may adopt various structures. For example, as regards a signal that is transmitted with use of the electric connector, if a fault occurs in one signal path, it is necessary to protect the signal that is transmitted. For this purpose, one method may be used in which the same signal is distributed to some other electrodes, thereby to secure the signal. However, the structure in which one signal is distributed to several electrodes increases the number of electrodes of the connector to be used, and also increases the fabrication cost. The method that provides such redundancy makes the wiring and the circuit itself complex. It is not practical to adopt such a method in all devices which are mounted.

Defective contact of a contact portion is a major factor of the defectiveness of the connector. In many cases, defective contact occurs due to resilient fatigue of the contact member itself, and contamination or damage of the surface of an associated electrode.

To solve this problem, a structure shown in FIG. 7, for instance, may be adopted. In this structure, a contact 70 is formed of a single metallic resilient member 71 for transmitting one signal. A distal end portion of the contact 70, which comes in contact with an associated electrode 72, is divided into two resilient contact arms 73, thereby effecting two-point contact. A method using this structure is adopted in order to cope with occurrence of defective contact. However, even in the case where the distal end portion of one contact is divided into two parts to effect two-point contact, as shown in FIG. 7, the proximal portion of the contact is a single part. Thus, if a problem occurs in the part other than the part that comes in contact with the associated electrode, there is no measure to cope with such a problem. In addition, in the structure shown in FIG. 7, there are some cases in which a uniform and sufficient contact pressure can hardly be secured.

Another method is shown in an exploded view of FIG. 8A to FIG. 8G, for instance. In this method, a silicone rubber connector 75 is used. In this silicone rubber connector 75, an electrically conductive sheet 79 as shown in part of FIG. 8B is used as a signal transmission member 78 which is interposed between upper and lower wiring boards 76 and 77 as shown in parts of FIG. 8A and FIG. 8D. As shown in parts of FIG. 8E and FIG. 8F, the electrically conductive sheet 79 can be formed by aligning, with high density, electrically conductive fibers 81 or electrically conductive rubber, or metallic particles, in a sheet-like member formed of insulative silicone rubber. A frame 83 shown in part of FIG. 8C has an inner wall 84. The inner wall 84 is located around the signal transmission member 78, for example, for the purpose of positioning of the signal transmission member 78 and structural reinforcement of the silicone rubber connector 75.

Part of FIG. 8E is a top view, and part of FIG. 8F is a cross-sectional view taken along line X-X' in part of FIG. 8E. As shown in parts of FIG. 8E and FIG. 8F, electrically conductive fibers 81, for instance, vertically extend, and accordingly an electric current flows only in the vertical direction. Part of FIG. 8G shows a contact state between the electrically conductive fibers 81 and contacts 85 of the wiring board. The resistance value of the connection part is determined by the number of electrically conductive fibers 81 per contact 85. By virtue of this structure, only the associated contacts 85 and 86 can surely be electrically connected in the stacked state in which the electrically conductive sheet 79 is disposed between the upper and lower wiring substrates 76 and 77.

In the silicone rubber connector, in particular, in the case where high reliability is required as in use for an artificial satellite, gold wires are buried, in typical cases, as the electrically conductive fibers 81, thereby to ensure the reliability. As regards the silicone rubber connector in which expensive gold wires are buried, such other problems arise that after the connector is once used, the connector cannot be recovered and used.

In addition, if a great load is applied to the silicone rubber connector, the silicone rubber connector cannot be re-used. Besides, with use of metal wires with excessively small diameters, it is difficult to increase a transfer speed by increasing the frequency of a signal that is transmitted.

An example of patent documents relating to connectors is Jpn. Pat. Appln. KOKAI Publication No. 2002-190335.

BRIEF SUMMARY OF THE INVENTION

The present invention has been made in consideration of the above-described problem, and the object of the invention is to provide a connector which can easily secure a uniform and sufficient contact pressure without making wiring and circuits complex. In addition, the object of the invention is to provide a connector which requires no use of expensive metallic material, and to provide contacts which are used in the connector.

In an electronic device which is used in an apparatus requiring very high reliability, such as an artificial satellite, if a fault occurs in a connector which transmits signals, the apparatus as a whole may be affected.

To avoid this problem, a plurality of through-holes, each receiving a pair of contacts with a narrow pitch, are formed in an insulator that constitutes a housing of a connector. Each pair of contacts of plural contacts is inserted in the associated narrow through-hole in the insulator. A pair of electric contact portions, which are formed at both end portions of each contact, are aligned with, and put in contact with, associated contact lands on two opposed wiring boards. Thus, contact engaging portions are provided in each through-hole of the insulator, in which each contact is received, and the contact engaging portions are disposed to mate with engaging portions which are formed on the contact that is composed of a resilient metallic member.

Specifically, according to an embodiment in the specification, there is provided a connector which includes a plurality of contacts, and an insulator having a plurality of through-holes for receiving the plurality of contacts. At least two of the plurality of contacts are disposed in each of the plurality of through-holes.

Further, according to another embodiment in the specification, there is provided contacts which are used in a pair. Each contact includes a resilient member on which a pair of contact portions are formed. The pair of contact portions are formed at both ends of the contact and come in electrical contact with associated electrodes on two opposed wiring boards which are used in an electronic device.

According to still another embodiment in the specification, there is provided an electronic device including a plurality of wiring boards which are stacked. The wiring boards are electrically connected by connectors. Each of the connector includes an insulator having a plurality of through-holes for receiving a plurality of contacts. A pair of contacts of the plurality of contacts is disposed in each of the through-holes.

As has been described above, at least two contacts, which are devised to be properly adaptive to each through-hole of the insulator, are disposed in the associated through-hole. Thereby, highly reliable signal processing can be performed without additionally providing a signal for ensuring contact in association with another electrode. Therefore, the size of the connector can be reduced, and accordingly the size of the electronic device can be reduced.

In the present invention, with use of the metallic contact, repetitive re-use of the contact after removal is realized. In addition, with use of the metallic contact, use at high signal frequencies is possible.

BRIEF DESCRIPTION OF THE SEVERAL VIEWS OF THE DRAWING

FIG. 7A and FIG. 7B show a contact which has two resilient contact arms that are put in two-point contact with an associated electrode; and FIG. 8A to FIG. 8G are an exploded view of a silicone rubber connector which electrically connects upper and lower wiring boards 76 and 77.

DETAILED DESCRIPTION OF THE INVENTION

Figure 1:
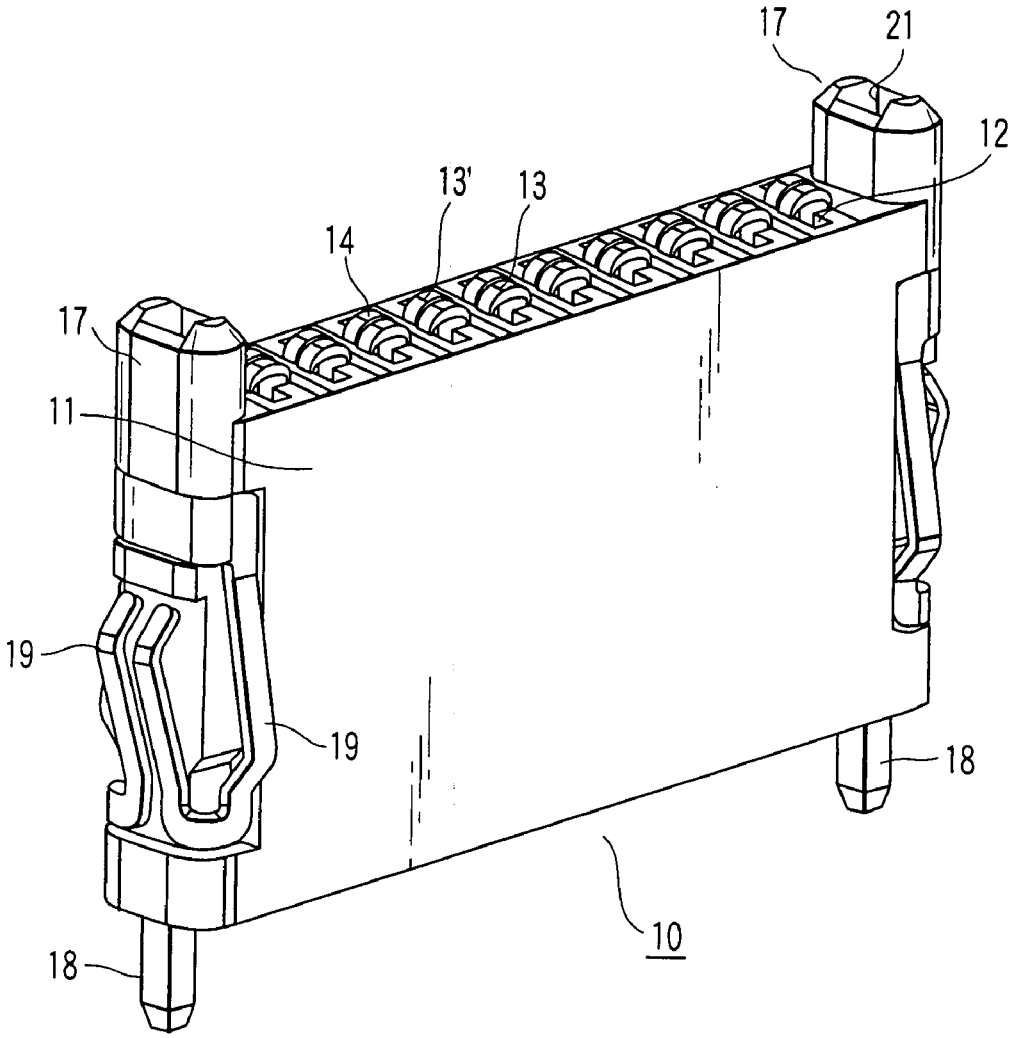
FIG. 1 is a perspective view showing an embodiment of the connector according to the present invention.
Figure 2A:
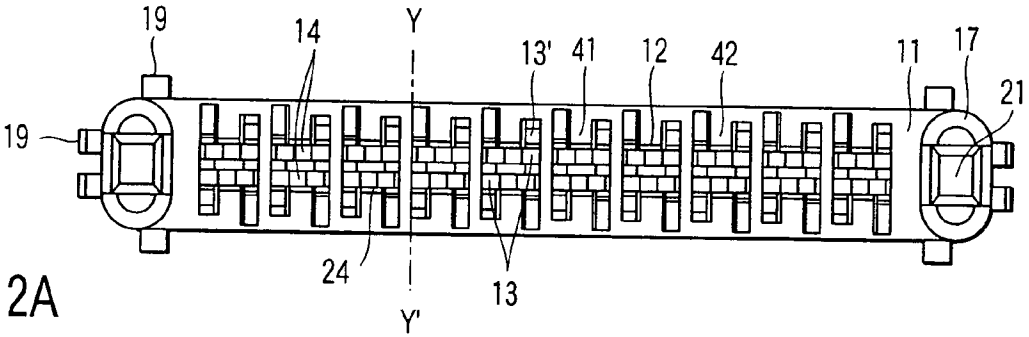
FIG. 2A is a plan view of the connector according to the invention shown in FIG. 1.
Figure 2B:
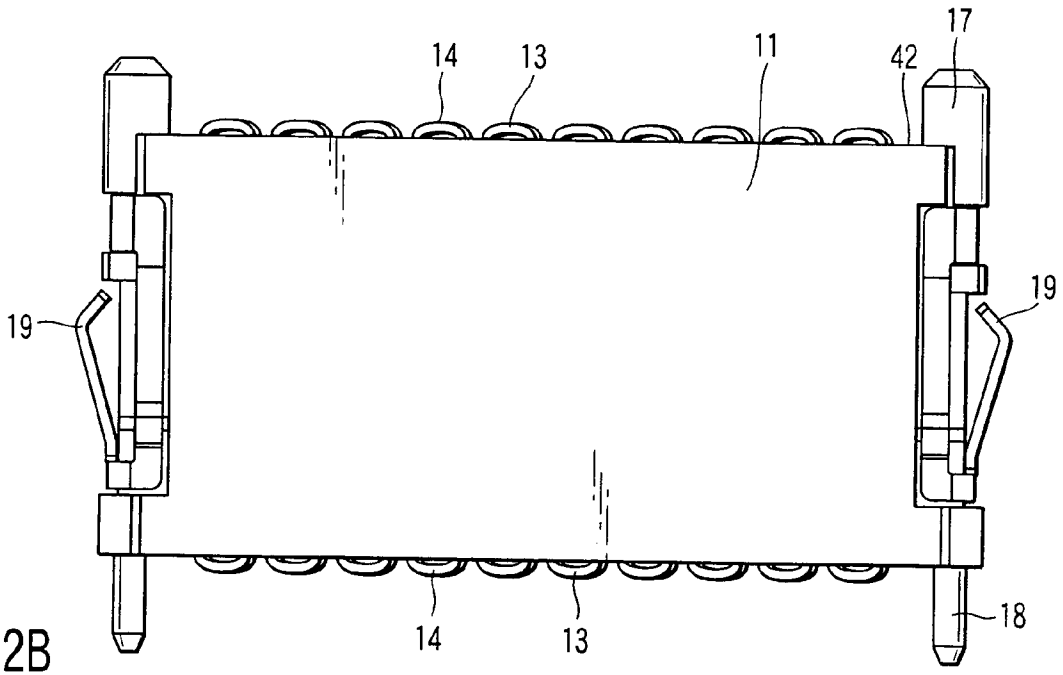
FIG. 2B is an elevation view of the connector according to the invention shown in FIG. 1.
Figure 2C:
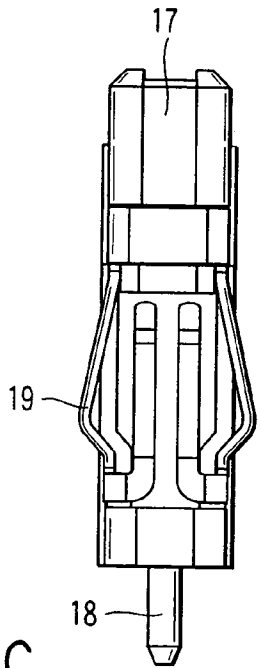
FIG. 2C is a side view of the connector according to the invention shown in FIG. 1.

FIG. 1 and FIGS. 2A to 2C show an embodiment of a connector 10 according to the present invention. FIG. 1 is a perspective view of the connector according to the embodiment of the invention. FIG. 2A is a plan view of the connector of the invention shown in FIG. 1. FIG. 2B is an elevation view of the connector of the invention shown in FIG. 1. FIG. 2C is a side view of the connector of the invention shown in FIG. 1.

An insulator 11 serves as a connector housing which is formed of, e.g. a synthetic resin such as plastics. A plurality of through-holes 12, which penetrate the insulator 11 in a vertical direction in the Figures, are formed in the insulator 11 in a linear arrangement. As shown in FIG. 2A, opening portions 24 of the through-holes 12 are arranged in a linear fashion on an upper surface 42 of the insulator 11.

A pair of contacts 13 and 13', which are formed of electrically conductive resilient members, are inserted and fixed in parallel in each of the through-holes 12. Electric contact portions 14 are formed on an upper part and a lower part of each contact 13, 13'. The electric contact portions 14 come in contact with associated electrode portions (i.e. contact lands) of an upper wiring board 15 and a lower wiring board 20 (see FIG. 3) (an associated lower electrode of the upper wiring board 15 is not shown).

As shown in FIG. 2B, first bosses 17 each having a large diameter and projecting upward of the insulator 11 are formed at right and left end portions of the insulator 11. The first bosses 17 can be used for alignment between the insulator 11 and the lower wiring board 20. In addition, as shown in FIG. 2B, second bosses 18 each having a small diameter and projecting downward of the insulator 11 are formed at the right and left end portions of the insulator 11. The second bosses 18 can be used for alignment between the insulator 11 and the upper wiring board 15.

As shown in FIG. 2A, a small-diameter boss receiving hole 21 is formed in each of the large-diameter first bosses 17. A small-diameter boss projecting from a lower part of another insulator (not shown), which is disposed above the insulator 11, can be inserted in the small-diameter boss receiving hole 21. In a case where a plurality of wiring boards are stacked via a plurality of connectors 10, small-diameter second bosses 18 of an upper connector 10 (not shown) are inserted in the small-diameter boss receiving holes 21 of the first bosses 17 of a lower connector 10. Thereby, the connectors 10 can precisely be aligned. Examples of the wiring boards 15 and 20 include a board having wiring on its surface, a board on which multi-layer wiring is formed, a board including circuit components such as semiconductor components, and a board including electronic modules such as a display device and a switch device.

In general, a frame (not shown) having an inner wall surrounding the insulator 11 can be disposed around the insulator 11, thereby to mechanically reinforce and protect the insulator 11. For example, refer to the frame 83 shown in FIG. 8C. The insulator 11 can be put in resilient contact with the inner wall of the frame 83 by a plurality of springs 19 (see FIG. 2B) formed on both end portions of the insulator 11, and can thus be fixed.

Figure 3:
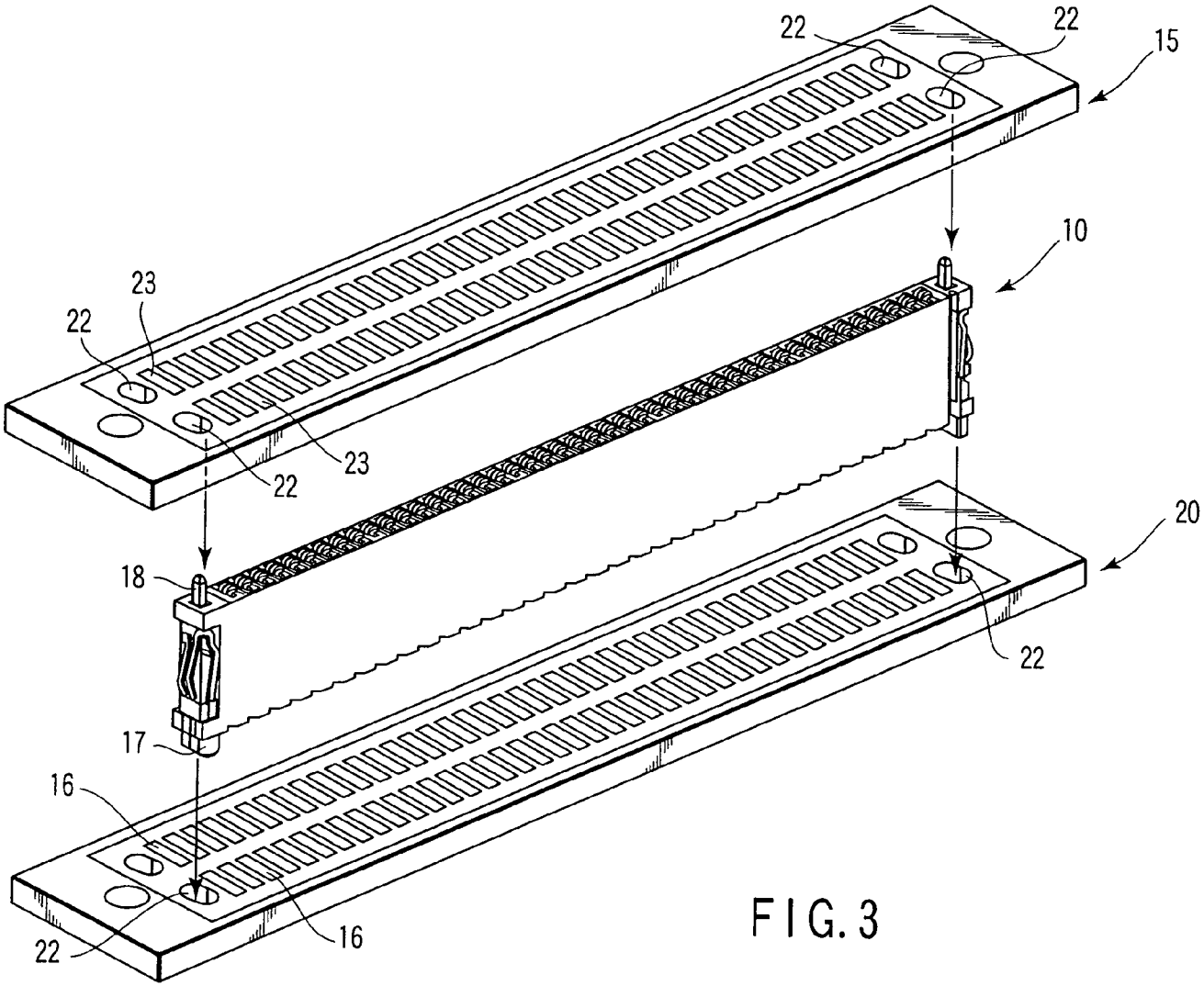
FIG. 3 shows a contact state between the connector according to the invention and upper and lower wiring boards.

FIG. 3 shows a connection state between the connector 10 and the upper wiring board 15 and lower wiring board 20. It is understood that FIG. 3 shows some of the mounted components of the embodiment which includes, for example, a plurality of wiring boards and a plurality of connectors. FIG. 3 shows two wiring boards 15 and 20 alone, but a large number (e.g. ten) of wiring boards may be stacked in actual use via a plurality of connectors 10.

Electrode portions 23, which are arranged on the upper surface of the upper wiring board 15, are electrodes for contact with contact portions of a connector (not shown) which is disposed above the upper wiring board 15. As shown in FIG.

3, boss insertion holes 22 are formed in the upper wiring board 15 and lower wiring board 20. The boss insertion holes 22 are used for alignment between the connector 10 and the wiring board 15, 20.

Figure 4:
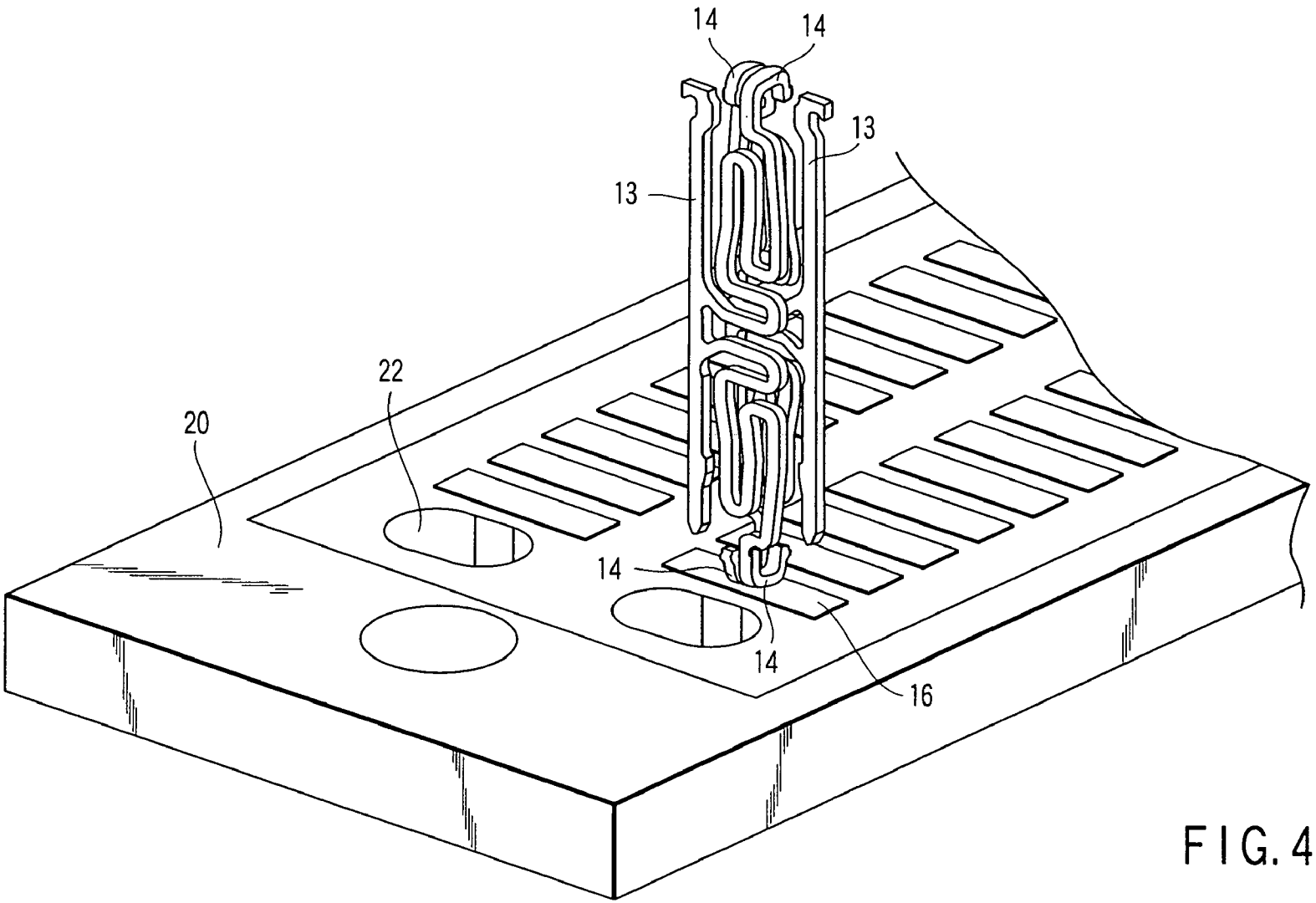
FIG. 4 shows a contact state between the lower wiring board and a pair of contacts according to the invention, which are formed by using metallic resilient members.

FIG. 4 shows a contact state between the lower wiring board 20 and a pair of contacts 13 which are formed by using metallic resilient members. FIG. 4 shows the state in which the insulator 11 and other pairs of contacts are removed. FIG. 4 shows an example of use in which a pair of contacts, which have the same shape, are disposed in opposite directions. The present invention is not limited to the use of the paired contacts having the same shape.

In FIG. 4, the paired contacts 13 and 13' are disposed vertically in parallel to each other. The paired contact portions 14 at the lower parts of the contacts 13 and 13' are put in resilient contact with the same electrode portion 16 formed on the surface of the lower wiring substrate 29. Thus, even if a fault occurs in one of the contacts 13, normal signal transmission is enabled by the other contact 13'. In order to keep good contact with the electrode portion 16, the contact surfaces 14 of the contacts 13 and 13' should preferably be formed as rolled surfaces, and not as broken surfaces.

Figure 5:
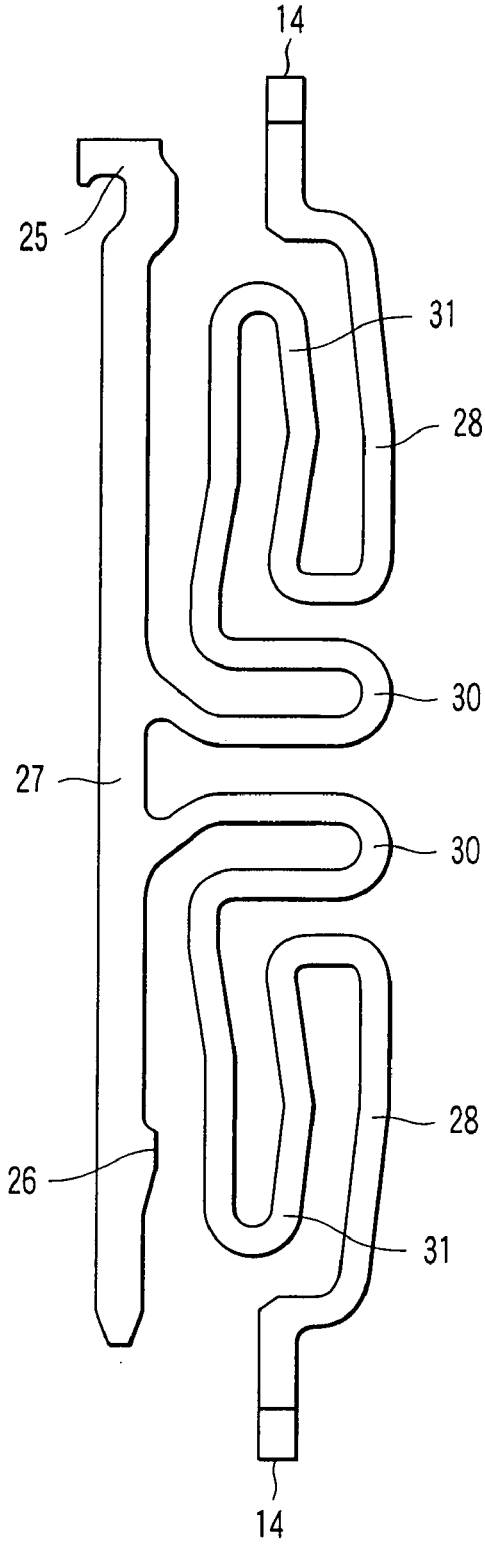
FIG. 5 shows an example of the contact according to the invention.

FIG. 5 shows an example of the contact 13 that is used in this embodiment. The shape of the contact 13, which is shown in FIG. 5, can be obtained by punching a thin metal plate or by subjecting it to a lithography process. The contact surface 14 is formed by bending itself in a rearward direction of the sheet surface of FIG. 5, for example, in a substantially U shape as shown in FIG. 4. This structure can increase the contact area of the contact surface 14 with the electrode portion formed on the surface of the board 15. By adopting this structure, the contact surface 14 can be formed as a rolled surface, and not as a broken surface.

In this invention, the shape of the contact is not limited to the example shown in FIG. 5. It should suffice if the contact is formed of a resilient member and has at least two contact surfaces which come in electrical contact with associated electrode portions (contact lands) formed on the two opposed wiring boards.

A vertically extending columnar portion 27 of the contact 13 of the embodiment shown in FIG. 5 includes a hook-shaped engaging portion 25 and a projection-shaped engaging portion 26 for engaging the contact 13 with the inner wall of the insulator 11. Thereby, the contact 13 can surely be fixed on the inner wall of the insulator 11.

In addition, as shown in FIG. 5, strip-shaped portions 28, which extend in up-and-down directions in a meandering fashion to the upper and lower contact portions 14, may be formed at middle parts of the columnar portion 17. Each strip-shaped portion 28 may include a U-shaped portion 30 which extends in a horizontal direction, and a U-shaped portion 31 which extends in a vertical direction. By virtue of such meandering portions, flexible and exact contact is realized between the contact 13 and the electrode portions 16 of the wiring boards.

Figure 6:
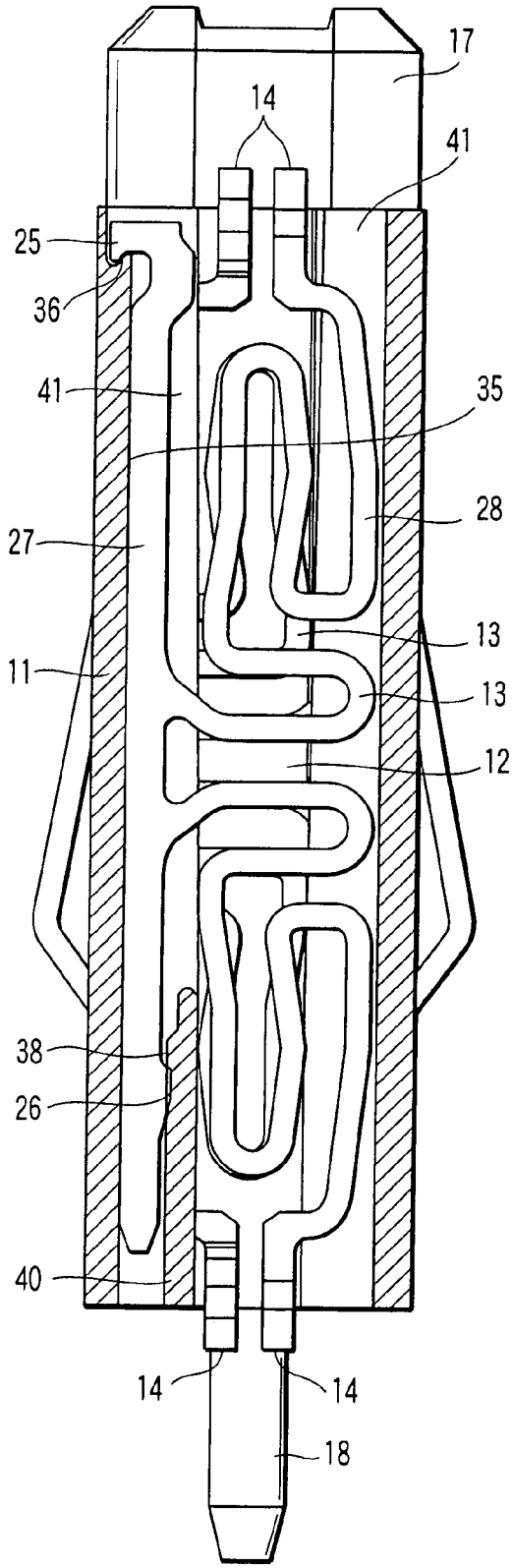
FIG. 6 is a cross-sectional view showing an assembled state of an insulator and the contact according to the invention which is disposed in a through-hole formed in the insulator.

FIG. 6 shows a cross section taken along line Y-Y' in FIG. 2. FIG. 6 shows the inside of the through-hole 12 formed in the insulator 11 and the contact 13 that is inserted and fixed in the through-hole 12. A groove portion 36, which constitutes an engaging portion for engaging the hook-shaped engaging portion 25 of the contact 13 and restricting downward movement of the contact 13, is formed in an upper part of the inner wall 35 of the insulator 11. In addition, an engaging portion 40 having a projection portion 38, which is mated with the projection-shaped engaging portion 26 of the contact 13, is formed in the through-hole 12.

The paired contacts 13 are disposed such that they are separated by a predetermined distance by a partial partition wall 41 within the through-hole 12. In this embodiment, two contacts are disposed in the through-hole 12. Alternatively, three contacts, for instance, may be disposed in the through-hole 12.

In the present invention, at least two contacts are disposed at mutually opposed positions in each of the plural through-holes 12 of the insulator 11. Thus, the engaging portion with the insulator can be disposed at a position separated from the contact portion, and the contact may include a resilient portion and a vertically bent portion of the contact portion which extends from that separated position. By virtue of this structure, even if the contacts are disposed at mutually opposed positions, their contact portions may be arranged in two rows on the same line.

The embodiment of the invention has been described above. However, the invention is not limited to the embodiment, and various modifications may be made, as needed.

What is claimed is:

1. A connector comprising:

a plurality of contacts; and an insulator having a plurality of through-holes for receiving the plurality of contacts, wherein each of the plurality of contacts comprises a resilient member and has rolled surfaces as contact surfaces, and two contacts of the plurality of contacts are disposed in each of the plurality of through-holes in such a manner that the contact surfaces of one of said two contacts face the respective contact surfaces of the other one of said two contacts in a direction perpendicular to a pitch array of the contacts that extends in a direction of a length of a connector and also extends in a direction substantially perpendicular to the plane of the contacts.

2. The connector according to claim 1, wherein each of the plurality of contacts includes electric contact portions at upper and lower end portions thereof.

3. The connector according to claim 1, wherein opening portions of the plurality of through-holes are arranged in a linear fashion on at least one surface of the insulator.

4. The connector according to claim 1, wherein said two contacts are disposed in parallel to each other within the through-hole.

5. The connector according to claim 1, wherein engaging portions for fixing the two contacts are formed on an inner wall of each of the plurality of through-holes.

6. Contacts which are used in a pair, each contact comprising:

a pair of contact portions which are formed at both ends of the contact and which come in electrical contact with associated electrodes on two opposed wiring boards which are used in an electronic device; and a resilient member which couples the pair of contact portions, wherein the contact portions are formed into rolled surfaces, and the contact portions of one of the contacts used in a pair face the respective contact portions of the other one of the contacts used in a pair in a direction perpendicular to a pitch array of the contacts that extends in a direction of a length of a connector and also extends in a direction substantially perpendicular to the plane of the contacts.

7. The contacts according to claim 6, wherein each of the contacts includes:

a vertically extending columnar portion; and strip-shaped portions extending from a middle portion of the columnar portion in up-and-down directions in a meandering fashion to the pair of contact portions.

8. The contacts according to claim 6, wherein a plurality of engaging portions for engaging the contact with an inner wall of an insulator, which receives the contact, are formed on the columnar portion.

9. The contacts according to claim 7, wherein the strip-shaped portion includes a U-shaped portion which extends in a horizontal direction, and a U-shaped portion which extends in a vertical direction.

10. An electronic device comprising:

a plurality of wiring boards which are stacked; and a plurality of connectors which are disposed between the plurality of wiring boards, thereby to electrically connect the plurality of wiring boards, wherein each of the connectors comprises:

a plurality of sets of contacts, each set being composed of a pair of contacts, each of the contacts comprising a resilient member and having rolled surfaces as contact surfaces, the contact surfaces of one of said pair of contacts facing the respective contact surfaces of the other one of said pair of contacts in a direction perpendicular to a pitch array of the contacts that extends in a direction of a length of a connector; and an insulator in which a plurality of through-holes each receiving the pair of contacts are formed and also extends in a direction substantially perpendicular to the plane of the contacts.

* * * * *